US006680661B2

(12) United States Patent
Hiroshima et al.

(10) Patent No.: US 6,680,661 B2
(45) Date of Patent: Jan. 20, 2004

(54) DIELECTRIC RESONATOR, DIELECTRIC FILTER, DIELECTRIC DUPLEXER, AND COMMUNICATION APPARATUS INCORPORATING THE SAME

(75) Inventors: Motoharu Hiroshima, Nomi-gun (JP); Hideyuki Kato, Ishikawa-gun (JP); Jun Toda, Ishikawa-gun (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 63 days.

(21) Appl. No.: 09/948,329

(22) Filed: Sep. 6, 2001

(65) Prior Publication Data

US 2002/0030559 A1 Mar. 14, 2002

(30) Foreign Application Priority Data

Sep. 8, 2000 (JP) ..... 2000-273346
Jul. 11, 2001 (JP) ..... 2001-210854

(51) Int. Cl.[7] ..... H01P 1/213

(52) U.S. Cl. ..... 333/134; 333/202; 333/206; 333/222

(58) Field of Search ..... 333/134, 208, 333/135, 202, 206, 222

(56) References Cited

U.S. PATENT DOCUMENTS 5,818,312 A * 10/1998 Noguchi et al. ..... 333/202
6,020,800 A * 2/2000 Arakawa et al. ..... 333/208
6,133,808 A * 10/2000 Arakawa et al. ..... 333/134
6,160,463 A * 12/2000 Arakawa et al. ..... 333/202
6,255,921 B1 * 7/2001 Arakawa et al. ..... 333/208
6,281,764 B1 * 8/2001 Arakawa et al. ..... 333/135
6,356,170 B1 * 3/2002 Arakawa et al. ..... 333/208

* cited by examiner

*Primary Examiner*—Brian Young
*Assistant Examiner*—John B Nguyen
(74) *Attorney, Agent, or Firm*—Dickstein, Shapiro, Morin & Oshinsky, LLP.

(57) ABSTRACT

The present invention provides a dielectric resonator, a dielectric filter, a dielectric duplexer capable of reducing leakage of electromagnetic waves and capable of being miniaturized, and a communication apparatus incorporating the same. In each of the dielectric resonator and filter, inside a dielectric block, there is formed a L-shaped inner-conductor-formed hole having a bend at some point of the hole in a manner extending from an outer surface of the dielectric block to a surface perpendicular to the outer surface. An inner conductor is formed on the inner surface of the inner-conductor-formed hole. On the substantially entire outer surfaces of the dielectric block, there is disposed an outer conductor, with one end of the inner-conductor-formed hole open-circuited and the remaining end of the hole short-circuited. Around the edge of the open-circuited end there is formed an outer coupling electrode. This structure enables formation of the dielectric resonator and the dielectric filter having the L-shaped inner-conductor-formed holes.

19 Claims, 12 Drawing Sheets

FIB. 6B

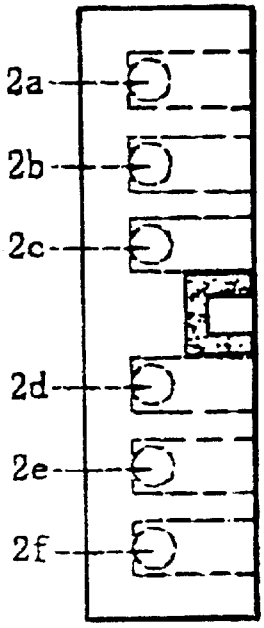
FIG. 7B
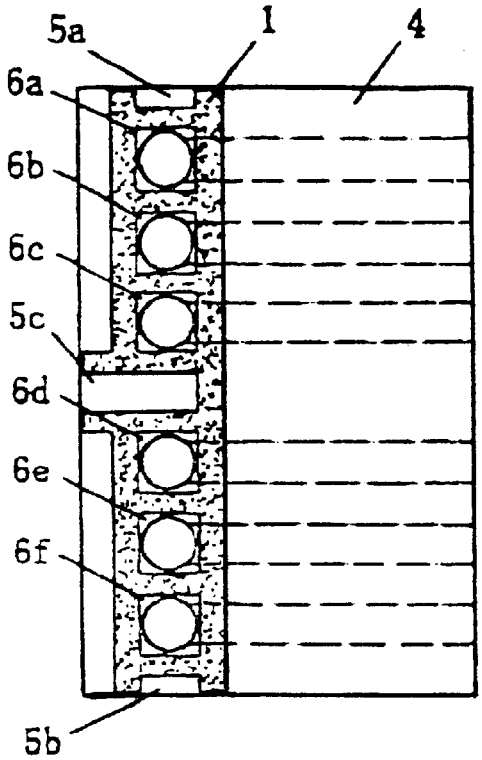
FIG. 7A
FIG. 7C
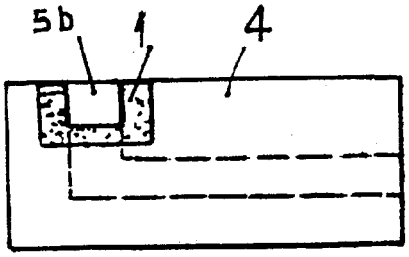

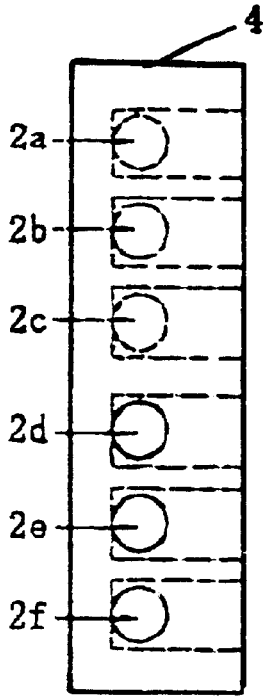
FIG. 8B
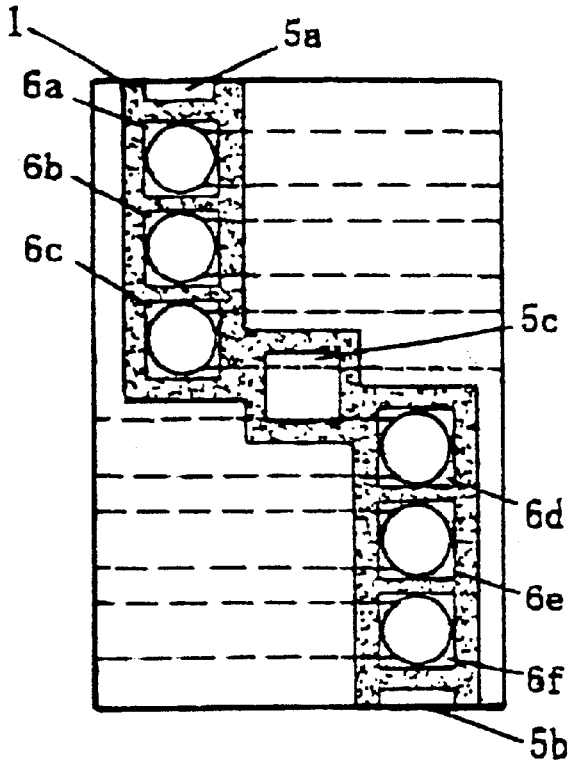
FIG. 8A
FIG. 8C
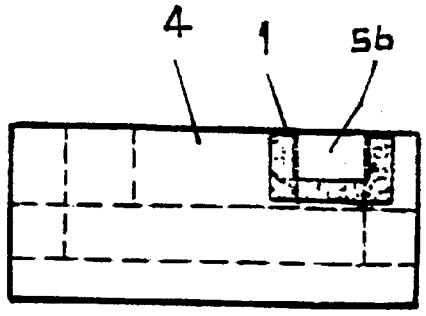

FIG. 11 A
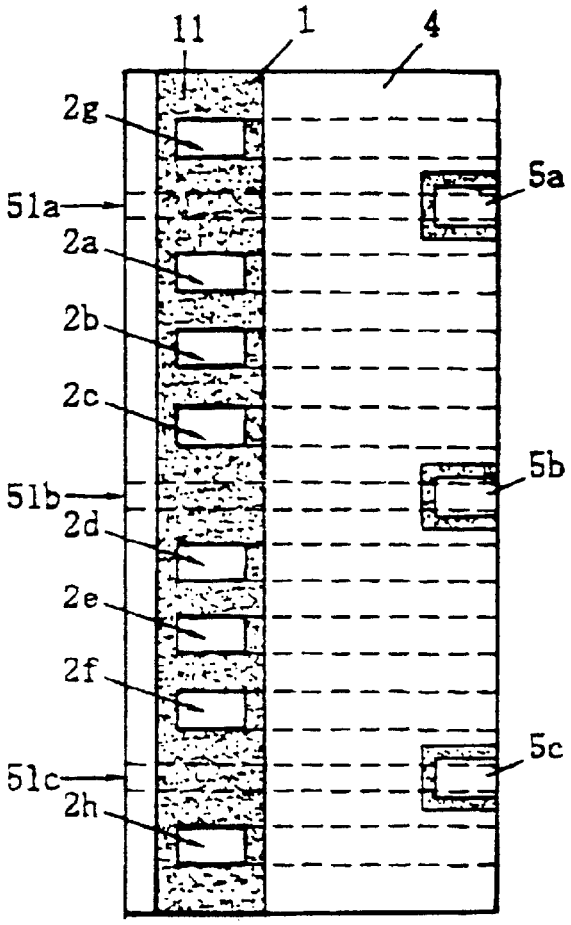
FIG. 11B
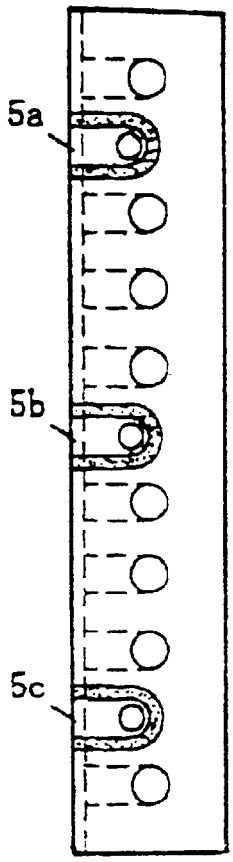
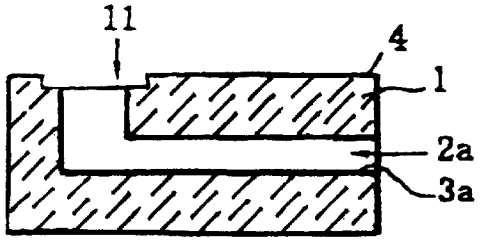
FIG. 11C
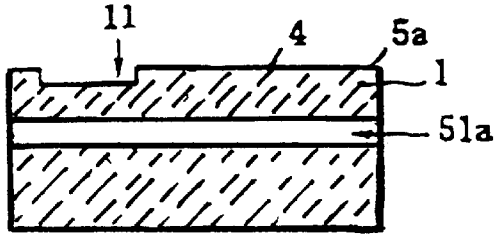
FIG. 11D

DIELECTRIC RESONATOR, DIELECTRIC FILTER, DIELECTRIC DUPLEXER, AND COMMUNICATION APPARATUS INCORPORATING THE SAME

BACKGROUND OF THE INVENTION

1. Field of the Invention

The present invention relates to dielectric resonators, dielectric filters, and dielectric duplexers which have plated through holes arranged inside dielectric blocks and outer conductors formed on the outer surfaces of the dielectric blocks. In addition, the invention relates to communication apparatuses incorporating the same.

2. Description of the Related Art

In a conventional dielectric resonator, a plurality of plated through holes (holes having inner conductors formed on the inner surfaces thereof) are formed inside a substantially rectangular parallelepiped dielectric block having an outer conductor arranged on the outer surfaces of the dielectric bock. One end of each of the plated through holes is open-circuited and the remaining end of each through hole is short-circuited.

The inner diameter of the short-circuited end of each plated through hole differs from the inner diameter of the open-circuited end thereof to form a stepped structure. With this structure, the axial length of each plated through hole is shortened. The stepped structure will be described with reference to FIGS. 14A and 14B.

FIG. 14A shows an external perspective view of a dielectric resonator and FIG. 14B shows a sectional view of the resonator.

In FIG. 14A, the reference numeral 1 denotes a substantially rectangular parallelepiped dielectric block. Plated through holes 2*a* and 2*b* extend from the left-front surface of the dielectric block to the right-rear surface thereof. The left-front surface in the figure is set as an open face, and, except for this surface, an outer conductor 4 is formed on substantially all of the remaining five surfaces of the dielectric block 1. Input/output electrodes 5*a* and 5*b* are arranged on outer surfaces of the dielectric block 1 and are isolated from the outer conductor 4. When the resonator is surface-mounted, the top surface shown in FIG. 14A is mounted on a circuit board (i.e., the top surface faces the mounting surface of the circuit board) and the input/output electrodes 5*a* and 5*b* are electrically coupled to electrodes arranged on the circuit board.

As best shown in FIG. 14B, the plated through holes 2*a* and 2*b* have stepped structures formed by forming steps located inside the dielectric block 1. With this stepped structure, as compared with a dielectric block including plated through holes 2*a* and 2*b* having substantially fixed inner diameters, the length of the holes can be reduced for a given wavelength. In this case, since the inner diameter of the open-circuited end (the left end in FIG. 14B) of the plated through hole is larger than the inner diameter of the short-circuited end (the right end as viewed in FIG. 14B) of the plated through holes, the thickness D between the outer surfaces and the wide diameter section of the plated through holes is small.

Next, other conventional dielectric resonators will be discussed with reference to FIGS. 15A and 15B. FIGS. 15A and 15B illustrate perspective views of two different dielectric resonators.

In both dielectric resonators, a plated through hole 2 extends from one surface of a dielectric block 1 to the opposing surface thereof. An outer conductor 4 is arranged on substantially the entire outer surface of the dielectric block 1. The inner conductor at the upper right end of the plated through hole 2 (the end not seen in the figures) is directly coupled to the outer conductor 4 forming a short-circuited end. The inner conductor at the other end of the plated through hole 2 is capacitively coupled to the outer conductor 4 forming an open-circuited end. In the embodiment of FIG. 15A, an outer coupling electrode 16 is directly coupled to the inner conductor on the plated through hole 2 but is isolated from the outer conductor 4. In this situation, the outer coupling electrode 5 extends from the open-circuited end of the plated through hole to a mounted surface on which the resonator is mounted.

In the dielectric resonator shown in FIG. 15B, on the open-circuit-end face (the left-front surface shown in the figure) of the plated through hole 2, an open-circuited end electrode 61 is directly coupled to the inner conductor of the plated through hole 2 and is capacitively coupled to both the outer conductor 4 and the outer coupling electrode 5. The outer coupling electrode 5 is isolated from the outer conductor 4 and is electrically coupled to a signal line on the circuit board on which the dielectric resonator is mounted.

A significant problem with these conventional dielectric resonators is that electromagnetic waves leak at the open-circuit end of the dielectric block. The leakage of the electromagnetic waves reduces the amount of ground current, thereby deteriorating filter attenuation characteristics. In order to prevent such deterioration, a cover for the open-circuited end is required.

In addition, in the structure shown in FIG. 15B, since coupling between the resonator defined by the plated through hole and the outer coupling electrode is performed only near the open-circuited end, the maximum coupling capacity is small, thereby narrowing the range of the obtainable coupling capacity.

In terms of the outer configuration, by using the stepped structure, the height of the dielectric block 1 can be reduced. However, when the height of the block 1 is 1.5 mm or less, the thickness of the dielectric block on the open-circuited-end side becomes smaller than the thickness of the possible formation limit. As a result, it is difficult to form the dielectric block 1.

SUMMARY OF THE INVENTION

Accordingly, it is an object of the present invention to provide a dielectric resonator, a dielectric filter, and dielectric duplexer, capable of reducing leakage of electromagnetic waves occurring at the open-circuited end side of a dielectric block to prevent deterioration of attenuation characteristics and maintaining sufficient outer coupling capacity without covering the open-circuited end, preferably with the dimensions of the devices reduced. It is another object of the invention to provide a communication apparatus incorporating the same.

According to an aspect of the invention, there is provided a dielectric resonator. In this resonator, there is arranged a plated through hole inside a dielectric block, the plated through hole having a L-shaped configuration, the opposite ends of the plated through hole extending through respective perpendicular surfaces of the dielectric block. An outer conductor is formed on outer surfaces of the dielectric block in such a manner that one end of the plated through hole is an open-circuited end and the other end of the plated through hole is a short-circuited end. Additionally, an outer coupling electrode is connected directly to the open-circuited end of the L-shaped plated through hole or indirectly connected thereto via a capacitive coupling.

The plated through hole preferably has first and second portions extending perpendicular to one another and the cross-sectional configuration of the first and second portions may differ from one another.

In addition, the open-circuited end of the plated through hole may be arranged on a mounted surface opposing (facing) a mounting substrate.

According to another aspect of the invention, there is provided a dielectric filter including the dielectric resonator of the first aspect of the invention and an input/output unit.

According to another aspect of the invention, there is provided a dielectric filter in which resonators formed by plated through holes which are coupled by placing the open-circuited ends of the plated through holes adjacent to each other.

In addition, this filter may further include resonator-coupling electrodes formed at the open-circuited ends of the plated through holes to mutually couple the resonators.

In addition, the inner diameter of an open-circuited end of each plated through hole may be larger than the inner diameter of the remaining close-circuit end of the plated through hole, and an edge on the open-circuited end having the larger inner diameter.

In addition, the input/output unit may include an outer coupling electrode separated from the outer conductor and an excitation hole having an inner electrode conducted to the outer coupling electrode.

According to another aspect of the invention, there is provided a dielectric duplexer using the dielectric resonator of the first aspect or the dielectric filter of the second aspect. The dielectric duplexer includes a plurality of pairs of the dielectric resonators or a plurality of pairs of the dielectric filters.

Furthermore, according to another aspect of the invention, there is provided a communication apparatus incorporating the dielectric resonator, the dielectric filter, or the dielectric duplexer according to the invention.

BRIEF DESCRIPTION OF THE DRAWINGS

Other features and advantages of the present invention will become apparent from the following description of the invention which refers to the accompanying drawings.

FIGS. 6A and 6B each illustrate an external perspective view of a dielectric filter according to a fifth and sixth embodiments of the invention;

FIGS. 7A to 7C illustrate a bottom view and side views of a dielectric duplexer according to a seventh embodiment of the invention;

FIGS. 8A to 8C illustrate a bottom view and side views of a dielectric duplexer according to an eighth embodiment of the invention;

FIGS. 11A to 11D illustrate a bottom view, a side view, and two side sectional views of a dielectric duplexer according to an eleventh embodiment of the invention;

DETAILED DESCRIPTION OF EMBODIMENTS OF THE INVENTION

Figure 1:
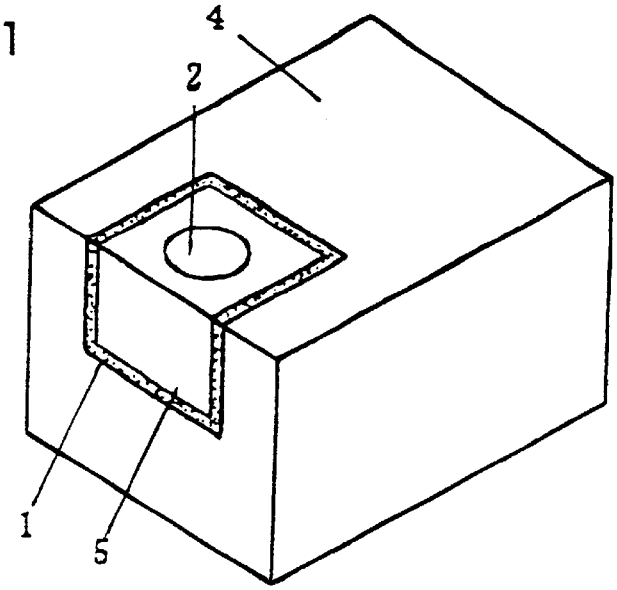
FIG. 1 is an external perspective view of a dielectric resonator according to a first embodiment of the present invention.
Figure 2A:
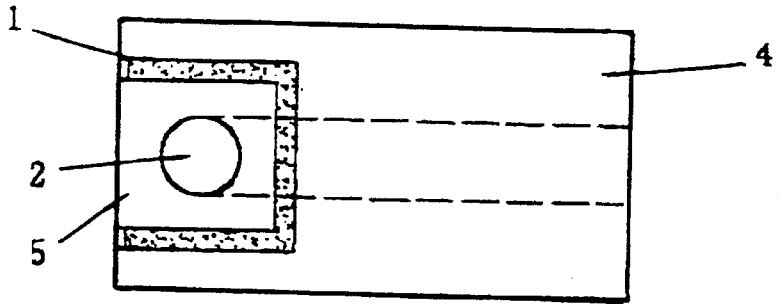
FIGS. 2A and 2B illustrate a bottom view and a side sectional view of the dielectric resonator of the first embodiment.
Figure 2B:
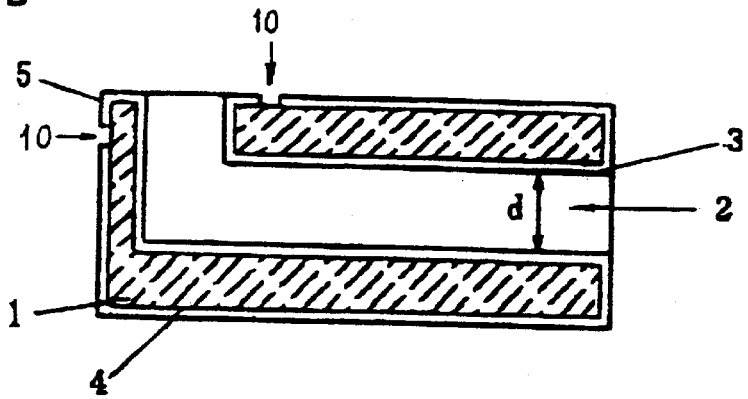

A description will be given of a dielectric resonator according to a first embodiment of the invention with reference to FIG. 1 and FIGS. 2A and 2B.

The dielectric resonator comprises a substantially rectangular parallelepiped dielectric block having an L-shaped plated through hole formed therein. The inner diameter d of the plated through hole 2 is constant throughout its length. An outer conductor 4 is formed on all of the outer surfaces of the dielectric block 1 except for the exposed area 10. An outer coupling electrode 5 is formed at the open-circuited end of the plated through hole 2 (the end seen at the top of FIG. 2) and is isolated from the outer conductor 4. When the dielectric resonator is surface-mounted on a circuit board, the open-circuited end of the plated through hole 2 is arranged to oppose (face) the circuit board and to be electrically connected to electrodes on the circuit board with the result that leakage of electromagnetic waves is substantially reduced (or even prevented).

Figure 3:
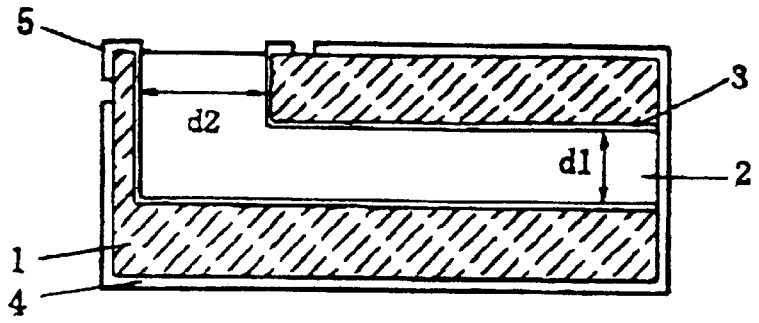
FIG. 3 is a side sectional view of a dielectric resonator according to a second embodiment of the invention.

Next, a description will be given of a dielectric resonator according to a second embodiment of the invention with reference to FIG. 3.

Like the first embodiment, an L-shaped plated through hole is formed in a substantially rectangular parallelepiped dielectric block 1 so that opposite ends of the plated through hole extend through perpendicular surfaces of the dielectric block. The plated through hole is formed of first and second perpendicular sections. However, in this embodiment, the inner diameter d2 of the section extending to the open-circuited end of the plated through holes 2 is larger than an inner diameter d1 of the section extending to the short-circuited end thereof. With this arrangement, the total axial length of the plated through hole 2 can be reduced relative to the first embodiment and, consequently, the outer dimensions of the dielectric resonator can be reduced. In addition, in each of the disclosed embodiments, the cross-sectional shape of the plated through hole is not restricted to a round shape. For example, the cross-sectional shape may be square.

Figure 4A:
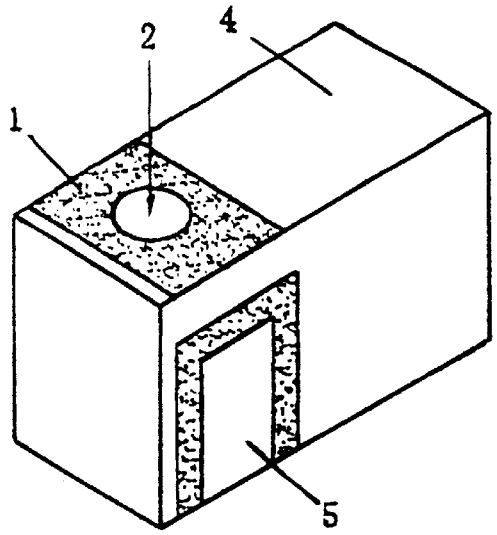
FIGS. 4A and 4B illustrate a bottom view and a side sectional view of the dielectric resonator of the second embodiment.
Figure 4B:
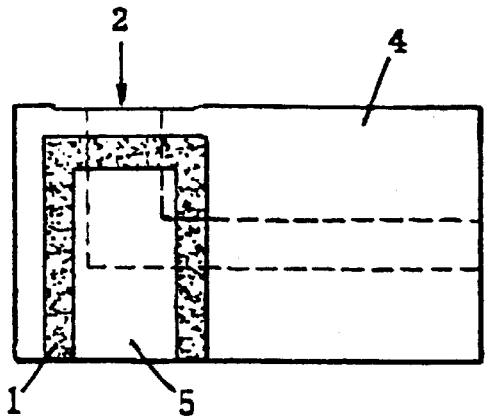

Next, a dielectric resonator according to a third embodiment of the invention will be described with reference to FIGS. 4A and 4B. Like the foregoing embodiments, this embodiment comprises a substantially rectangular parallelepiped dielectric block 1 having an L-shaped plated through hole 2 formed therein, and both an outer conductor 4 and an outer coupling electrode 5 formed thereon. Once again, the L-shaped plated through hole 2 includes first and second perpendicular sections which extend to perpendicular outer surfaces of the dielectric block 1. The section extending to the upper surface as viewed in FIG. 4B is the open-circuited end and the section extending to the right surface as viewed in FIG. 4B is the short-circuited end. An outer conductor 4 is formed on a substantially entire outer surface of the dielectric block 1 except for a predetermined area surrounding the open-circuited of the plated through hole and the exposed areas defining the outer coupling electrode 5 located on the side surface of the dielectric block 1. The outer coupling electrode 5 is isolated from the outer conductor 4.

In this embodiment, the dielectric resonator is mounted on the circuit board with the side containing the outer coupling electrode faced down. The open-circuited end of the plated through hole 2 will not face the circuit board and certain leakage will occur. However, this embodiment has several other advantages described below.

In this embodiment, the outer coupling electrode 5 is capacitively coupled to the inner conductor formed in the plated through hole near the open-circuited end of the L-shaped plated through hole 2. Since the outer coupling electrode 5 can be formed on either the right-front surface or the left-back surface of the dielectric block as viewed in FIG. 4A, the freedom of designing the arrangement of the outer coupling electrode can be increased.

In addition, since the inner conductor on the plated through hole and the outer coupling electrode 5 are capacitively coupled to each other over a wide area, the coupling capacity obtained between the resonator and the outer coupling electrode can be increased.

Figure 5:
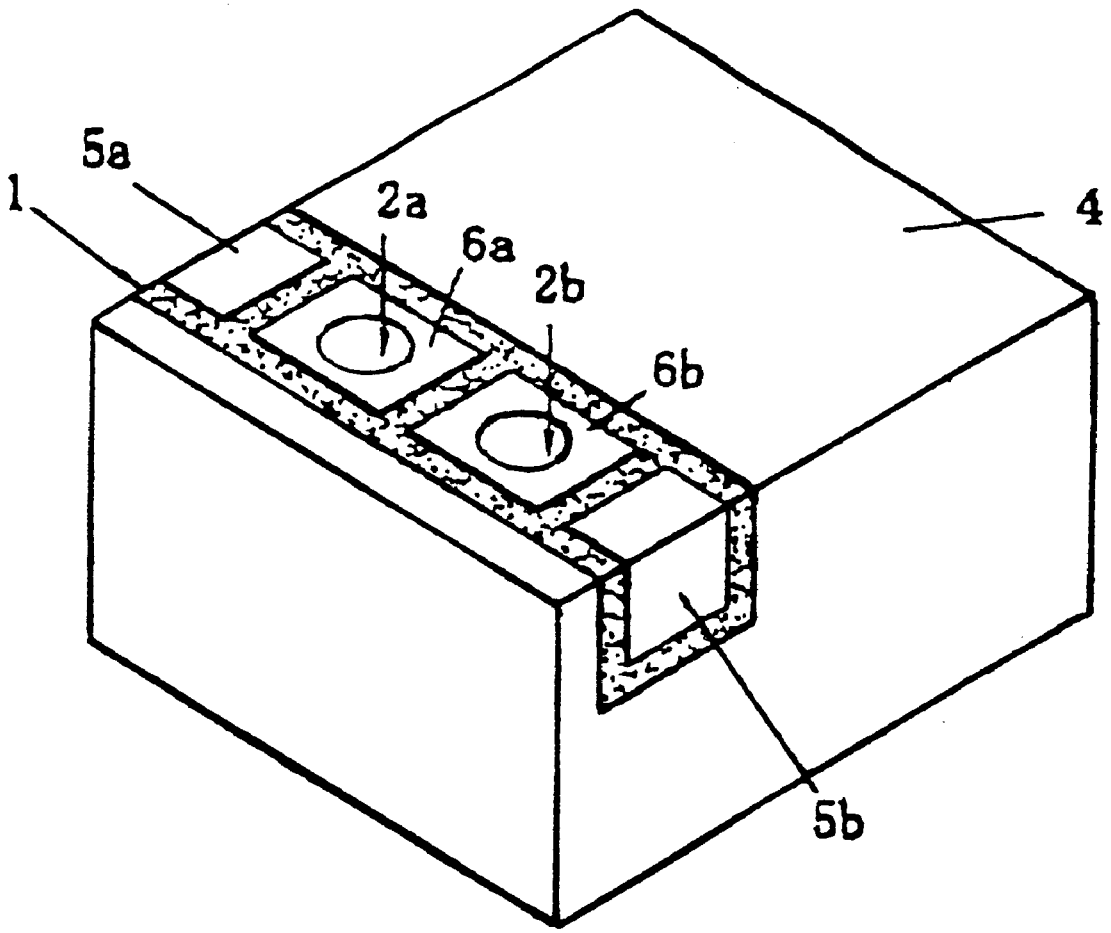
FIG. 5 is an external perspective view of a dielectric filter according to a fourth embodiment of the invention.

Next, a description will be given of a dielectric filter according to a fourth embodiment of the invention with reference to FIG. 5. In this embodiment, a pair of L-shaped plated through holes are formed in a substantially rectangular dielectric block 1. The plated through holes extend from the right-back surface of the dielectric block 1 (as viewed in FIG. 5) to the top surface thereof. The ends of the plated through holes located at the top surface of the dielectric block are the open-circuited ends. An outer conductor 4 is formed on the outer surfaces (six surfaces) of the dielectric block.

Resonator-coupling electrodes 6*a* and 6*b* are formed around the open-circuited ends of the plated through holes 2*a* and 2*b*. Outer coupling electrodes 5*a* and 5*b*, which are capacitively coupled to the resonator-coupling electrodes 6*a* and 6*b*, are isolated from the outer conductor 4. When the resonator is surface mounted, the top surface shown in the figure opposes (faces) the circuit board and the outer coupling electrodes 5*a* and 5*b* are coupled to electrodes on the circuit board. With this arrangement, leakage of electromagnetic waves at the open-circuited ends can be reduced and it is unnecessary to cover the open-circuit ends.

Next, a description will be given of a dielectric filter according to fifth and sixth embodiments of the invention with reference to FIGS. 6A and 6B. In both embodiments, the resonator includes a substantially rectangular parallelepiped dielectric block 1 having a pair of L-shaped plated through holes 2*a*, 2*b* formed therein. Each of the plated through holes has a rectangular cross-section. Each through hole includes a first section extending from the right rear face of the dielectric block as viewed in FIGS. 6A and 6B towards the front face thereof and a second section extending from the recess 11 formed in the top face thereof towards the bottom face of the dielectric block.

The ends of the plated through holes 2*a*, 2*b* located at the right rear face of the dielectric block 1 are coupled to the outer electrode 4 and define close-circuited ends of the through holes. The ends of the plated through holes extending to the recess 11 formed in the top surface of the dielectric block 1 are separated from the outer conductor 4 and define closed-circuited ends of the through holes 2*a* and 2*b*.

Figure 6A:
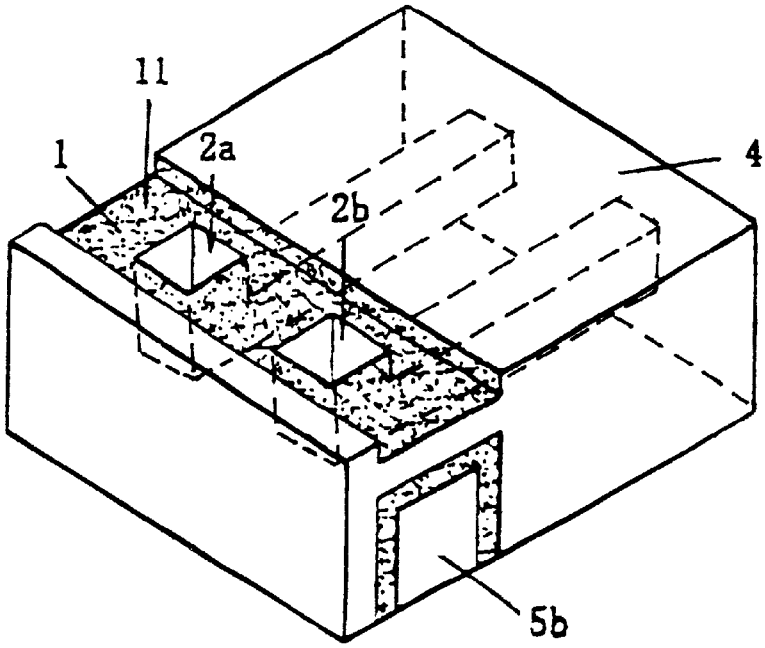
Figure 6A:
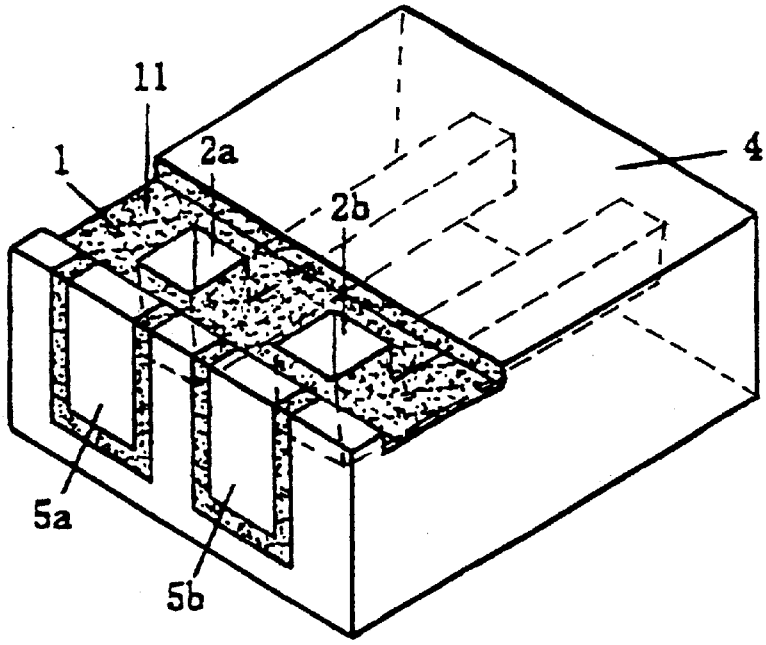

In FIG. 6A, an outer coupling electrodes 5*a* (not shown) and 5*b* are disposed on respective left and right end faces of the dielectric block 1. In FIG. 6B, outer coupling electrodes 5*a* and 5*b* are disposed on the front left surface of the dielectric block 1.

With the arrangement of FIG. 6A, the inner conductors forming the portion of the plated through holes 2*a* and 2*b* located near the open-circuited ends of the through holes and the outer coupling electrodes 5*a*, 5*b*, respectively, oppose each other to be capacitively coupled to each other via the dielectric material of the dielectric block 1. As a result, since the opposing electrode area increases, the range of an obtainable capacity can be broadened, thereby increasing the freedom of designing the coupling capacity.

The open-circuited end face of the L-shaped plated through holes is set to be opposed to (i.e., is mounted on) the mounting surface (e.g., a circuit board) when the dielectric filter is mounted thereon. As a result, leakage of an electromagnetic field at the open-circuit end face can be reduced or prevented. Furthermore, since there is a gap between the mounting surface and the open-circuited end of the through holes (due to the presence of the step 11), the capacity generated between them can be reduced, thereby preventing variations in the resonator characteristics after it is mounted on the mounting surface.

Next, a description will be given of a dielectric duplexer according to a seventh embodiment of the invention with reference to FIGS. 7A, 7B, and 7C. In this embodiment, a plurality of L-shaped plated through holes 2*a* to 2*f* is formed in a substantially rectangular parallelepiped dielectric block 1 so that each of the through holes extends from an end face (the right end face as viewed in FIG. 7C) to a top face (the upper face as viewed in FIG. 7C) of the dielectric block 1. An outer conductor 4 is disposed on the outside of the dielectric block 1, except for an area around edges as open-circuited end of the plated through holes. Resonator coupling electrodes 6*a* to 6*f* are formed around the edges of the open-circuited ends of the plated through holes 2*a* to 2*f*, respectively. In addition, coupling electrodes 5*a* and 5*b*, which are capacitively coupled to the resonator coupling electrodes 6*a* to 6*f*, respectively, are formed on the outer surface of the dielectric block 1. Another outer coupling electrode 5*c*, which is capacitively coupled to the resonator coupling electrodes 6*c* and 6*d*, is also formed on the outer surface of the dielectric block 1. The outer coupling electrode 5*a* is used as a transmission signal input terminal, the outer coupling electrode 5*b* is used as a reception signal output terminal, and the outer coupling electrode 5*c* is used as an antenna terminal. By mounting the surface of the dielectric block having the open-circuit ends (the top surface as viewed in FIG. 7C) on a circuit board, the dielectric filter is surface-mounted and the outer coupling electrodes 5*a*, 5*b*, and 5*c* are coupled to respective electrodes on the circuit board. With this arrangement, leakage of electromagnetic waves at the open-circuited ends of the plated through holes can be reduced or eliminated and it is unnecessary to cover the open-circuited ends.

Next, a description will be given of a dielectric duplexer according to an eighth embodiment of the invention with reference to FIGS. 8A, 8B, and 8C.

As in the seventh embodiment, L-shaped plated through holes 2*a* to 2*f* are formed in a substantially rectangular parallelepiped dielectric block 1. However, in this embodiment, the closed-circuited end of half of the plated through holes extend to the left side surface of the dielectric block (as viewed in FIG. 8A) and the closed-circuited end half of the plated through holes extend to the right side surface thereof. The open-circuited ends of all of the plated through holes extend to the top surface of the dielectric block 1 (as viewed in FIG. 8C). Each of the open-circuited ends is isolated from the outer conductor 4. Resonator-coupling electrodes 6*a* to 6*f* are formed on the top surface of the dielectric block 1 around the plated through holes 2*a* and are respectively coupled to the conductive plating in the through holes.

Outer coupling electrodes 5*a* and 5*b* are formed on the top and end faces of the dielectric block 1 and are isolated from the outer conductor 4. An additional outer coupling electrode 5*c* is formed between the resonator-coupling electrodes 6*c* and 6*d* on the top surface of the dielectric block 1. The dielectric filter is surface-mounted on a circuit board by mounting the top surface of the dielectric block 1 having the open-circuited ends of the plated through hole on (facing) a circuit board and connecting the outer coupling electrodes 5*a*, 5*b*, and 5*c* to respective electrodes disposed on the circuit board. With this arrangement, leakage from the open circuited ends of the plated through holes is reduced or eliminated. This arrangement can prevent unnecessary coupling between the transmission filter composed of plated through holes 2*a* to 2*c* and the reception filter composed of plated through holes 2*d* to 2*f*.

Next, a description will be given of a dielectric duplexer according to the ninth embodiment of the invention with reference to FIGS. 9A, 9B, and 9C.

Figure 9B:
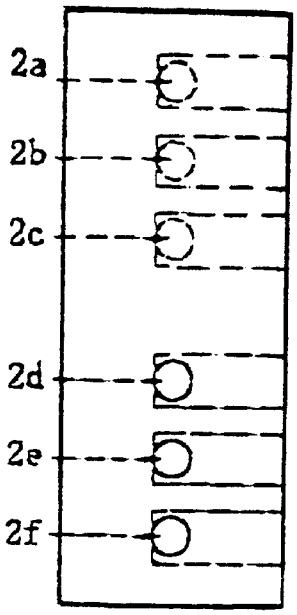
FIGS. 9A to 9C illustrate a bottom view and side views of a dielectric duplexer according to a ninth embodiment of the invention.
Figure 9A:
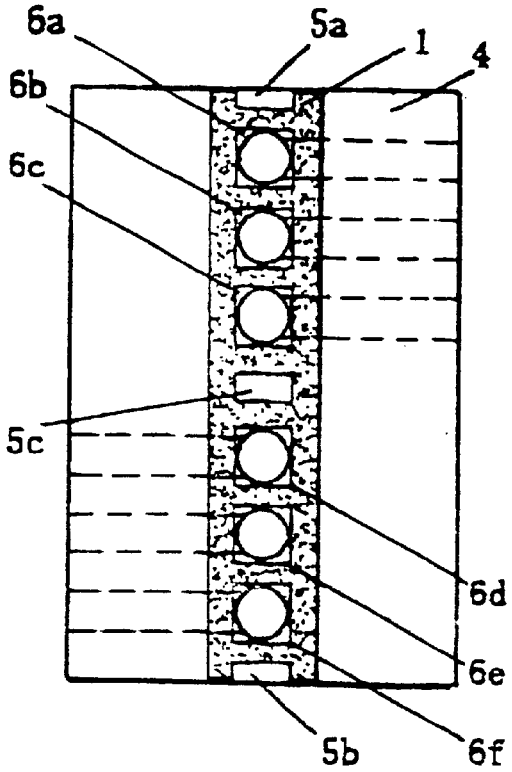

In this embodiment, a transmission filter defined by a plurality of L-shaped plated through holes 2*a* to 2*c* is formed in the top half of a dielectric block 1 as viewed in FIG. 9A and a reception filter is formed by a plurality of L-shaped through holes 2*d* to 2*f* formed in the lower half of the dielectric bock 1. The inner conductors of the plated through holes 2*a* to 2*c* are directly coupled to the outer conductor 4 to form short-circuited ends thereof. The inner conductors of the plated through holes 2*d* to 2*f* are similarly directly coupled to the outer conductor 4 to form short-circuited ends thereof. The ends of the plated conductors 2*a* to 2*f* extending to the upper surface of the dielectric block 1 a viewed in FIG. 9C are isolated from the plated through hole 4 to form open-circuited ends thereof.

Coupling electrodes 6*a* to 6*f* are formed at the open-circuited ends of the plated through holes 2*a* to 2*f*, respectively, and are directly coupled to the inner conductors thereof. The coupling electrodes 6*a* to 6*c* capacitively couple the plated through holes 2*a* to 2*c* to one another. The coupling electrodes 6*d* to 6*f* capacitively couple the plated through holes 2*d* to 2*f* to one another.

Outer coupling electrodes 5*a*, 5*b* and 5*c* are formed on the outer surface of the dielectric block 1. The coupling electrode 5*a* is capacitively coupled to the transmission filter defined by plated through holes 2*a* to 2*c* and is typically connected to a transmission circuit. The outer coupling electrode 5*b* is capacitively coupled to the reception filter defined by plated through holes 2*d* to 2*f* and is typically coupled to a reception circuit. The outer coupling electrode 5*c* is capacitively coupled to both the transmission and reception filters and is typically coupled to an antenna.

In this ninth embodiment, the open-circuit ends of the plated through holes preferably extend along a single line bisecting the dielectric block as viewed in FIG. 9A. As a result, the extent of the overlap of the through holes of the transmission filter on the one hand and the through holes of the reception filter on the other hand is reduced so as to reduce undesired coupling between the transmission and reception filters.

Figure 10A:
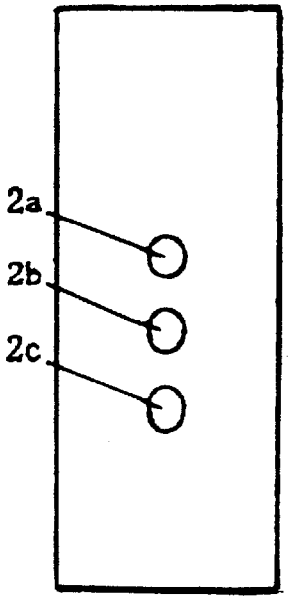
FIGS. 10A to 10C illustrate a bottom view and side views of a dielectric duplexer according to a tenth embodiment of the invention.
Figure 10B:
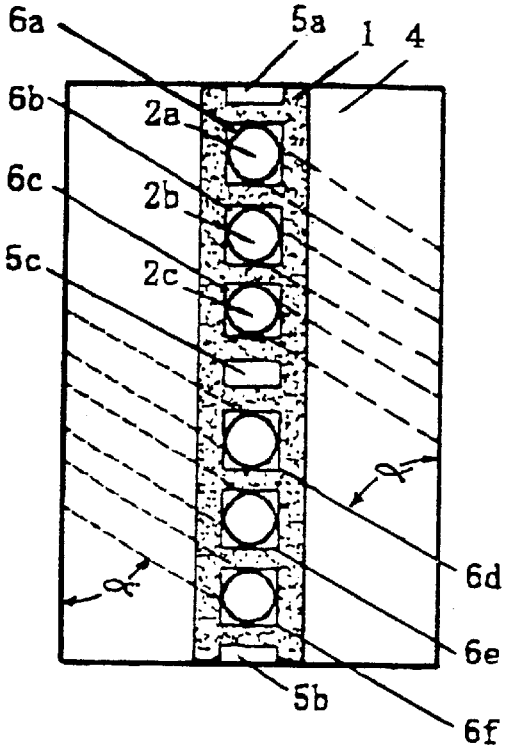
Figure 10C:
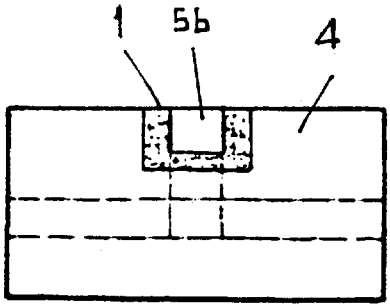

Next, a description will be given of a dielectric duplexer according to a tenth embodiment of the invention with reference to FIGS. 10A, 10B, and 10C.

Figure 9C:
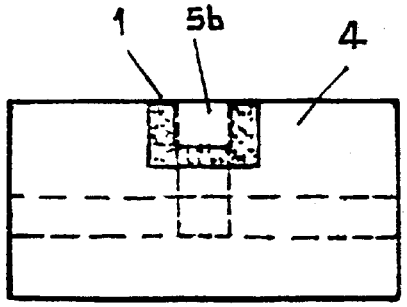

This embodiment is substantially identical to the embodiment of FIGS. 9A through 9C except that the plated through holes 2*a* to 2*c* extend at an acute angle $\alpha$ with respect to the respective side edges of the dielectric block to which the short-circuited ends extend. This arrangement can prevent unnecessary coupling between the transmission filter formed by the plated through holes 2*a*, 2*b*, and 2*c* and a reception filter formed by the plated through holes 2*d*, 2*e*, and 2*f*. In addition, reducing the axial lengths of the plated through holes, the entire duplexer can be made compact.

Next, a description will be given of a dielectric duplexer according to an eleventh embodiment of the invention with reference to FIGS. 11A to 11D.

Each of the L-shaped plated through holes 2*a* to 2*g* extends from the same side surface (the right hand surfaces viewed in FIG. 11C) to the bottom surface of the dielectric block (the top surface as viewed in FIG. 11C). Each L-shaped plated through hole includes a first section having a round cross-section (the horizontal section in FIG. 11C) and a second section having a rectangular cross-section (the vertical section in FIG. 11C).

As in the prior embodiments, an outer conductor 4 is formed on substantially the entire outer surface of the dielectric block and is directly coupled to the short-circuited end of the L-shaped through holes. The remaining ends of the L-shaped through holes are open-circuited ends and terminate at a recess 11 formed in the bottom surface of the dielectric block 1.

Excitation holds 51*a*, 51*b* and 51*c* are formed between front and rear surfaces of the dielectric block 1 as best shown in FIGS. 11A and 11D. Inner conductors are formed on the inner surfaces of the excitation holds 51*a* to 51*c*.

The plated through holes 2*a* to 2*c* cooperate to force a transmission filter and the plated through holes 2*d* to 2*f* cooperate to force a reception filter. Outer coupling electrodes 5*a* and 5*c* serve as input/output terminals coupled to the transmission filter and reception filter, respectively, and the outer coupling electrode 5*b* serves as an antenna terminal coupled to both the transmission and reception filters. The plated through hole 2*g* couples with the excitation hole 51*a* and the plated through hole 2*h* couples with the excitation hole 51*c* to serve as trap resonators. The outer coupling electrodes 5*a* to 5*c* are isolated from the outer conductor 4 and are capacitively coupled to the excitation holes 51*a* to 51*c*, respectively.

Because the excitation holes 51*a* to 51*c* extend along large portions of the adjacent plated through holes, the coupling capacity between the excitation holes and the plated through holes can be increased.

As a result, even when the dielectric duplexer is miniaturized, the coupling capacity between the outer coupling electrodes 5*a* to 5*c* and the plated through holes can be sufficiently obtained. Moreover, since the open-circuited end face of the plated through holes is mounted to face the circuit board, leakage of an electromagnetic field can be reduced. Similarly, due to the presence of the recess 11, unnecessary capacity between the mounted surface and the open-circuited ends of the plated through holes can also be reduced, thereby preventing variations in the characteristics of the filter after it has been mounted on the circuit board.

In the dielectric resonators, the dielectric filters, and dielectric duplexers shown in the aforementioned embodiments, the sections of the inner-conductor-formed holes are round or square. However, the sectional shapes are not restricted to those. For example, the sectional shapes of the inner-conductor-formed holes may be polygonal.

Figure 12A:
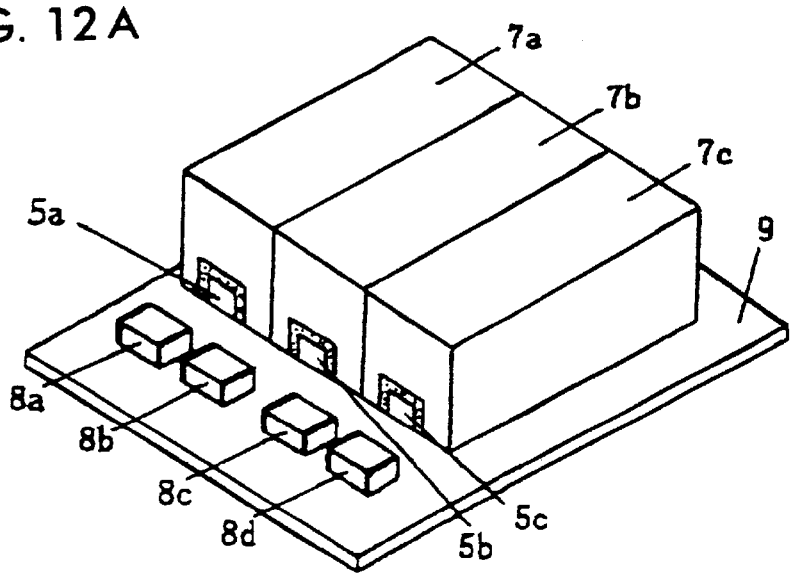
FIGS. 12A and 12B illustrate an external perspective view and an equivalent circuit diagram of a band pass filter according to a twelfth embodiment of the invention.
Figure 12B:
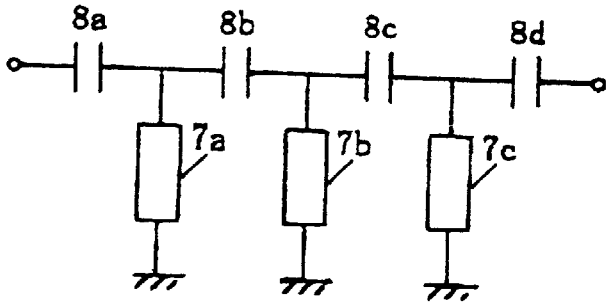

Next, a description will be given of a band pass filter according to a twelfth embodiment of the invention with reference to FIGS. 12A and 12B.

In this embodiment, three surface-mounted dielectric resonators 7*a*, 7*b*, and 7*c* having the same configurations as those shown in the first and second embodiments are mounted on a circuit board 9. In addition, capacitors 8*a* to 8*d* are arranged between the outer coupling electrodes of the dielectric resonators and between the outer electrodes of the band pass filter (not shown) to form a circuit which is equivalent to the equivalent circuit shown in FIG. 12B.

Next, a description will be given of a communication apparatus according to a thirteenth embodiment of the invention with reference to FIG. 13. The communication apparatus includes the dielectric resonator, the dielectric filter, or the dielectric duplexer described above.

Figure 13:
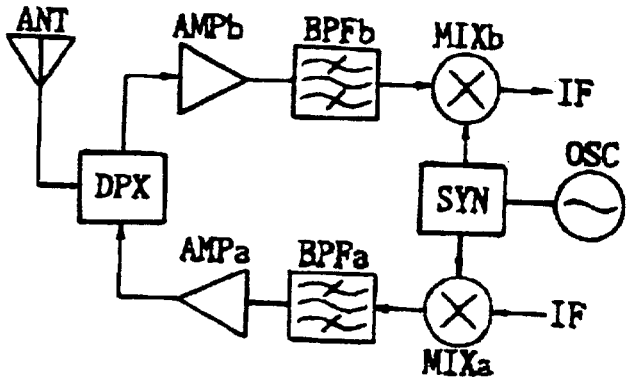
FIG. 13 illustrates a block diagram of a communication apparatus according to a thirteenth embodiment of the invention.
Figure 14A:
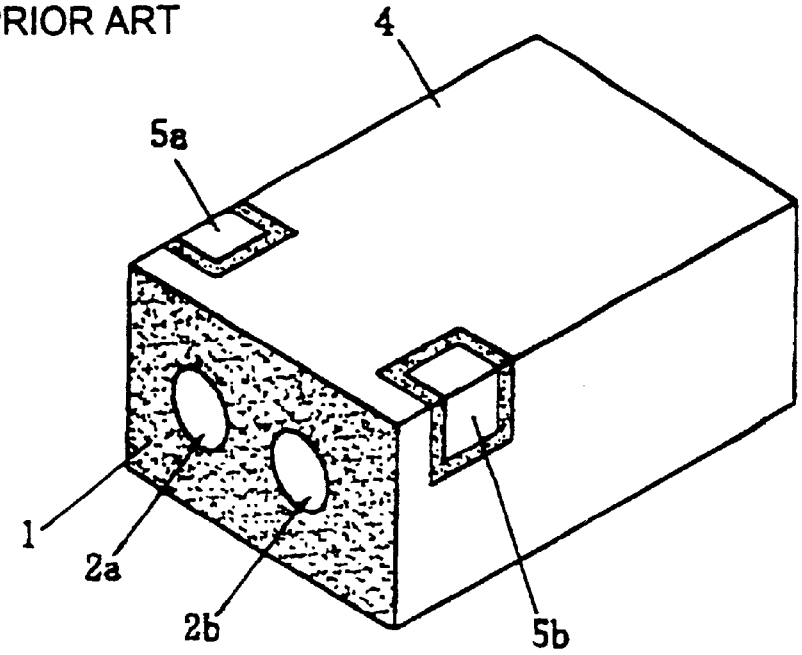
FIG. 14A PRIOR ART
FIGS. 14A and 14B illustrate an external perspective view and a side sectional view of a conventional dielectric resonator having a stepped structure.
Figure 14B:
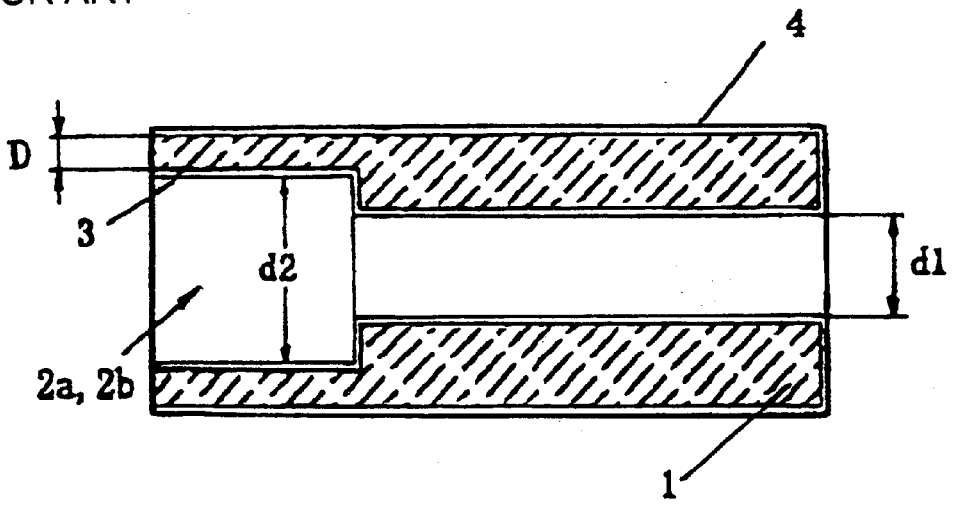
FIG. 14B PRIOR ART
Figure 15A:
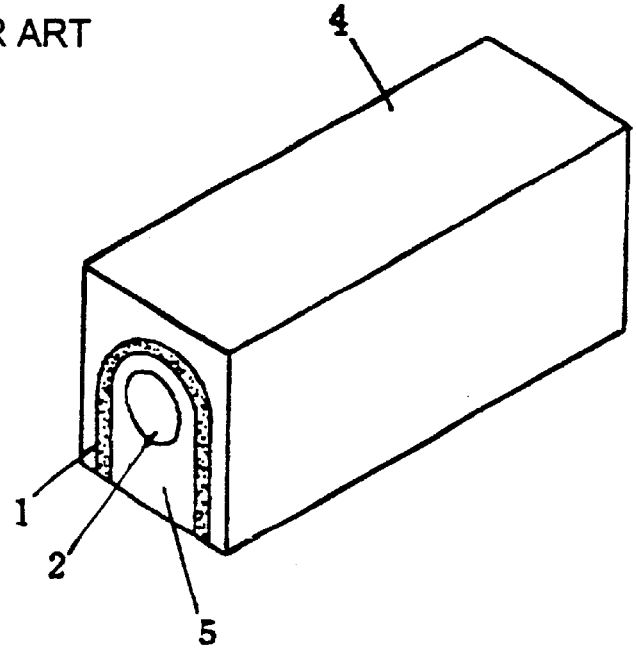
FIG. 15A PRIOR ART
FIGS. 15A and 15B each illustrate an external perspective view of another conventional dielectric resonator.
Figure 15B:
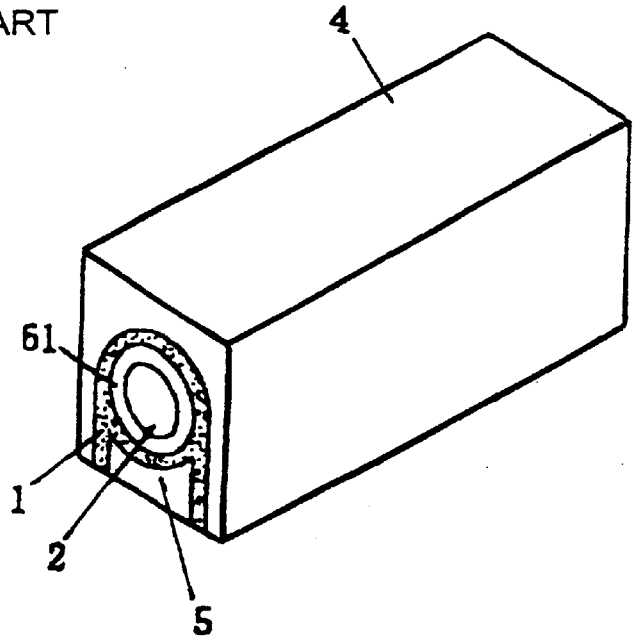
FIG. 15B PRIOR ART

In FIG. 13, there are shown a transmission/reception antenna ANT, a duplexer DPX, band pass filters BPFa and BPFb, amplifying circuits AMPa and AMPb, mixers MIXa and MIXb, an oscillator OSC, a synthesizer SYN, and intermediate frequency signals IF.

The duplexer having the structure shown in each of FIGS. 7A, 7B, and 7C to FIGS. 11A, 11B, 11C, and 11D can be used as the duplexer DPX shown in FIG. 13. In addition, the dielectric filter having the structure shown in each of FIG. 1 to FIGS. 6A and 6B can be used as the band pass filters BPFa and BPFb. Also, the band pass filter shown in FIGS. 12A and 12B may be applicable. In this manner, with the use of the compact dielectric filter and the compact dielectric duplexer capable of reducing leakage of electromagnetic waves and obtaining necessary attenuation characteristics, a compact communication apparatus having desired communication capabilities can be designed.

As described above, in this invention, the dielectric resonator capable of reducing leakage of electromagnetic waves is surface-mounted on a circuit board, and also, the height of the dielectric resonator can be decreased.

In addition, the dielectric filter capable of reducing leakage of electromagnetic waves can be surface-mounted on a circuit board, and the height of the dielectric filter can be decreased.

In addition, in this invention, sufficient coupling capacity can be easily obtained between the resonators and the outer coupling electrodes.

In addition, the dielectric duplexer of the invention capable of reducing leakage of electromagnetic waves and loss can be surface-mounted on a circuit board. Also, the height of the dielectric duplexer can be decreased.

Furthermore, the communication apparatus of the invention can be miniaturized and can prevent leakage of electromagnetic waves so that desired communication capabilities can be obtained.

While the preferred forms of the present invention have been described, it is to be understood that modifications will be apparent to those skilled in the art without departing from the spirit of the invention. The scope of the invention, therefore, is to be determined solely by the following claims.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator comprising:

a substantially rectangular parallelepiped dielectric block having one surface which includes a recess;

a plated through hole arranged inside the dielectric block, the through hole having a L-shaped configuration and extending from a first surface of the dielectric block to a second surface of the dielectric block which is perpendicular to the first surface; wherein said hole has an end terminating in the recess;

an outer conductor formed on outer surfaces of the dielectric block in such a manner that one end of the plated through hole is spaced from the outer conductor to define an open-circuited end of the plated through hole and the other end of the plated through hole is connected to the outer electrode to define a short-circuited end thereof; and an outer coupling electrode electrically connected to the open-circuit end of the plated through hole.

2. A dielectric resonator according to claim 1, wherein the outer coupling electrode is directly coupled to the plated through hole.

3. A dielectric resonator according to claim 1, wherein the outer coupling electrode is capacitively coupled to the plated through hole.

4. A dielectric resonator according to claim 1, wherein the plated through hole has two linear sections extending perpendicular to one another, the cross-sectional configuration of the two sections being different from one another.

5. A dielectric filter comprising the dielectric resonator according to claim 1 further comprising input/output means electrically coupled to the plated through hole.

6. A dielectric resonator according to claim 1, wherein the open circuited end of the plated through hole terminates in the recess.

7. A dielectric resonator comprising:

a dielectric block having first and second outer surfaces which are perpendicular to one another having one surface which includes a recess;

a plated through hole arranged inside the dielectric block, the through hole having a bent configuration and extending from the first surface of the dielectric block; wherein said hole has an end terminating in the recess;

an outer conductor formed on outer surfaces of the dielectric block in such a manner that one end of the plated through hole is spaced from the outer conductor to define an open-circuited end of the plated through hole and the other end of the plated through hole is connected to the outer conductor to define a short-circuited end thereof and an outer coupling electrode electrically connected to the open-circuited end of the plated hole.

8. A dielectric resonator according to claim 7, wherein the outer coupling electrode is directly coupled to the plated through hole.

9. A dielectric resonator according to claim 7, wherein the outer coupling electrode is capacitively coupled to the plated through hole.

10. A dielectric resonator according to claim 7, wherein the plated through hole has two linear sections extending perpendicular to one another, the cross-sectional configuration of the two sections being different from one another.

11. A dielectric filter comprising the dielectric resonator according to claim 7, further comprising input/output means electrically coupled to the plated through hole.

12. A dielectric resonator according to claim 7, wherein the open circuited end of the plated through hole terminates in the recess.

13. A dielectric filter comprising:

a dielectric resonator including a substantially rectangular parallelepiped dielectric block, a plurality of L-shaped plated through holes arranged inside the dielectric block, each of the through holes extending from a first surface of the dielectric block to a second surface of the dielectric block which is perpendicular to the first surface, an outer conductor formed on outer surfaces of the dielectric block in such a manner that one end of each of the plated through holes is spaced from the outer conductor to define a respective open-circuited end of the plated through hole and the other end of each of the plated through holes is connected to the outer conductor to define a short-circuited end thereof; and having one surface which includes a recess;

input/output means;

wherein the open-circuited ends of the plated through holes are adjacent to each other to mutually couple resonators formed by the plated through holes; wherein said holes have an end terminating in the recess.

14. A dielectric filter according to claim 13, further comprising resonator-coupling electrodes formed at the open-circuited ends of the plated through holes to mutually couple the plated through holes to one another.

15. A dielectric filter according to claim 14, wherein each of the plated through holes has first and second linear sections which meet at an angle, the inner diameter of the first section of each through hole being larger than the inner diameter of the second section of each through hole, the first section extending to the open circuited end of the through hole, the second section extending to the closed circuited end of the through hole.

16. A dielectric filter according to claim 14, wherein the input/output means comprises an outer coupling electrode isolated from the outer conductor and an excitation hole having an inner electrode conducted to the outer coupling electrode.

17. A dielectric duplexer comprising the dielectric resonator according to any one of claims 1, 2, 3, 4 or 6, or the dielectric filter according to any one of claims 13, 14, 15 or 16, the duplexer comprising a plurality of pairs of the dielectric resonators or a plurality of pairs of the dielectric filters.

18. A communication apparatus comprising the dielectric resonator according to any one of claims 1, 2, 3, 4 or 6, or the dielectric filter according to any one of claims 13, 14, 15 or 16.

19. A communication apparatus comprising the dielectric duplexer according to claim 17.

* * * * *